US007387175B2

(12) United States Patent
Zeer

(10) Patent No.: US 7,387,175 B2
(45) Date of Patent: Jun. 17, 2008

(54) WINDOW REAMING AND CORING APPARATUS AND METHOD OF USE

(76) Inventor: Robert L. Zeer, 860 Manhattan Road, Kelowna, British Columbia (CA) V1Y 1H5

( * ) Notice: Subject to any disclaimer, the term of this patent is extended or adjusted under 35 U.S.C. 154(b) by 250 days.

(21) Appl. No.: 10/562,033

(22) PCT Filed: Dec. 22, 2004

(86) PCT No.: PCT/CA2004/002192

§ 371 (c)(1),
(2), (4) Date: Dec. 22, 2005

(87) PCT Pub. No.: WO2005/061845

PCT Pub. Date: Jul. 7, 2005

(65) Prior Publication Data

US 2006/0157246 A1 Jul. 20, 2006

(51) Int. Cl.
*E21B 10/32* (2006.01)
*E21B 49/06* (2006.01)

(52) U.S. Cl. ..... 175/285; 175/20; 175/58

(58) Field of Classification Search ..... 166/55, 166/298, 264; 175/58, 20, 263, 285; 73/152.11
See application file for complete search history.

(56) References Cited

U.S. PATENT DOCUMENTS 1,750,629 A * 3/1930 Crum ..... 175/278
1,862,629 A * 6/1932 Morrison ..... 175/258
1,885,550 A * 11/1932 Santiago ..... 175/274
2,315,629 A * 4/1943 Le Bus ..... 175/267
2,511,508 A * 6/1950 McClinton ..... 175/58
3,073,389 A * 1/1963 Conner ..... 166/55.8
3,630,296 A * 12/1971 Bullard ..... 175/77
4,356,872 A * 11/1982 Hyland ..... 175/58
5,029,653 A * 7/1991 Jurgens et al. ..... 175/58
5,103,921 A * 4/1992 Zeer et al. ..... 175/81
5,163,522 A * 11/1992 Eaton et al. ..... 175/58
5,188,190 A * 2/1993 Skaalure ..... 175/58

(Continued)

FOREIGN PATENT DOCUMENTS

GB 2.234.278 A * 1/1991

(Continued)

OTHER PUBLICATIONS

International Search Report (ISR), Dabrowski, Edward (CA), Mar. 24, 2005, pp. 2-3.*

*Primary Examiner*—Jennifer H Gay
*Assistant Examiner*—John M Deboer
(74) *Attorney, Agent, or Firm*—Sean W. Goodwin

(57) ABSTRACT

Window reaming and coring apparatus has a reamer connected in the middle of the tool by mechanical joints which permit the reamer to be displaced substantially parallel to the rest, of the tool body. The apparatus is lowered adjacent a pre-determined zone of interest and mills a parallel window along the edge of an existing wellbore into which the reamer is displaced. Once the reamer is fully displaced laterally into the window, the reamer and coring head can be rotated parallel to the wellbore, in the zone of interest for obtaining and retrieving a crescent-shaped core which has a significant cross section and length, enabling improved analysis of the wellbore lithography.

20 Claims, 14 Drawing Sheets

U.S. PATENT DOCUMENTS 5,209,309 A * 5/1993 Wilson ..... 175/58
5,211,715 A * 5/1993 Braden et al. ..... 175/58
5,568,838 A * 10/1996 Struthers et al. ..... 175/246
6,066,844 A * 5/2000 Ford et al. ..... 250/227.21
6,474,415 B1 * 11/2002 Ohmer ..... 166/297
2006/0231258 A1 * 10/2006 Head et al. ..... 166/298

FOREIGN PATENT DOCUMENTS

GB 2234278 A 1/1991

* cited by examiner

A-A

A-A

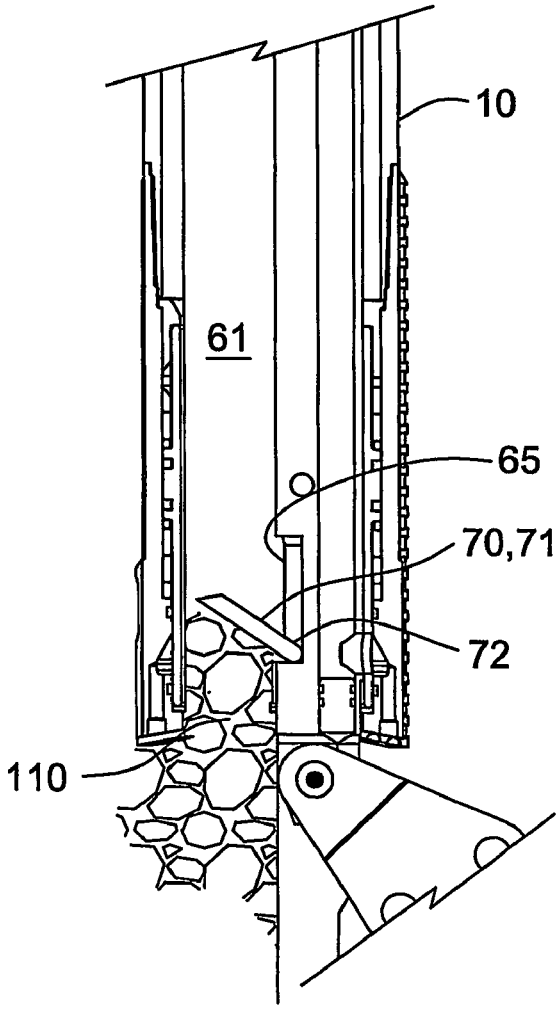
Fig. 14a
Fig. 14b
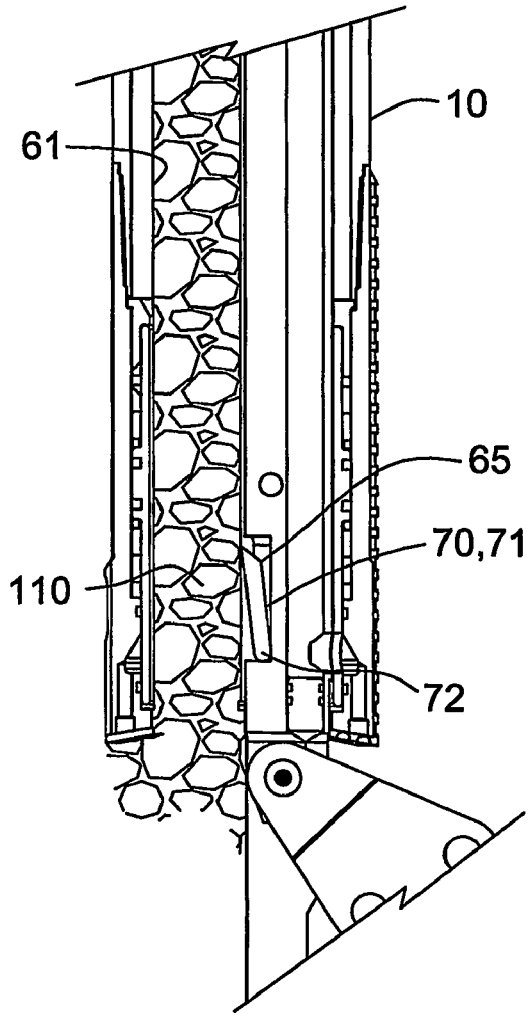

WINDOW REAMING AND CORING APPARATUS AND METHOD OF USE

FIELD OF INVENTION

Embodiments of the invention relate to drilling operations and a tubular workstring for reaming of parallel windows along the side of a wellbore. More particularly, the window can be used to place and position drilling tools in order to: start entry to a lateral section of the well and to harvest a long core along the wellbore sidewall.

BACKGROUND OF THE INVENTION

It is known to cut windows in a sidewall of a main wellbore to drill offset or lateral wellbores from the main wellbore and for creating a pocket or window from which a core sample may be obtained.

The best-known and most widely used method for redirecting a drill bit off-center of a wellbore is by first setting a wedge-type device, known as a whipstock, by means of retaining it to the walls of the wellbore using slips and friction. A drill bit is then lowered and pushed to the side of the wellbore at the angle of the whipstock to start a sidetrack hole. Typically, windows cut using a whipstock may be rough and may present some difficulties when tying back the offset wellbore to the main wellbore's casing or liner. Typically, reaming a window using a whipstock requires multiple trips into the wellbore. Further, the full width and depth of the window can only be achieved at the bottom end of the whipstock.

During drilling of wellbores, conventional core samples are often taken to obtain information relative to the formations. Typically, coring occurs at the bottom of the wellbore during the process of deepening the hole. Typically, the process requires that the drill string be tripped out and a coring tool be run in for obtaining the core sample, after which the coring tool is removed and the drill string is run in to further deepen the borehole to total depth. The need for multiple trips into and out of the wellbore makes conventional coring time consuming and relatively expensive. Further, as the location for obtaining core samples is selected before drilling through a zone of interest, the formation cannot be assessed using well logging techniques and the like and therefore the core samples often have little or no value in assessing the wellbore.

Further, conventional wireline coring tools and technologies have imposed limitations regarding the retrieval of a useful length of continuous core, or can retrieve only very small samples of rock by means of trepan drilling or impacting perpendicularly into the wellbore wall.

Sidetrack coring tools form independent offset boreholes by projecting below a reaming collar or deflection tool. The coring tube may become trapped in the offset borehole and may not be retrievable therefrom. Further, other problems occur as a result of penetration of zonal interfaces without means for sealing the offset borehole and formation of short boreholes formed along a curved trajectory which compromise the ability to harvest a long, continuous, undisrupted core sample therefrom.

One form of coring assembly, set forth by Applicant in U.S. Pat. No. 5,103,921, suffers from some of the disadvantages of the prior art systems. A deflection crank at a lower end of a reaming and coring tube, contained within a reaming collar, and a universal ball joint at a top end of the reaming tube permit displacement of a lower end of the reaming tube for reaming a window into the main wellbore wall, after which the reaming tube projects below the reaming collar for cutting an angled offset borehole from which a core sample is obtained.

An improved, cost effective and reliable window reaming and coring apparatus, which is capable of cutting and retrieving long cores having a sizeable cross-section and which are substantially continuous and representative of the lithography of the main wellbore, is required. Further, the apparatus should be readily tripped in and out of the wellbore without risk of the apparatus becoming stuck during reaming or coring. Preferably, cutting of the core samples should occur after the wellbore has been drilled and logged to ensure that the samples taken represent zones of interest along the wellbore.

SUMMARY OF THE INVENTION

Apparatus and method are provided for milling a substantially parallel window or windows into the sidewall of an existing wellbore that is cased or uncased, using a single round trip of the apparatus. A reamer, connected between and upper and lower section of the apparatus by upper and lower lateral displacement means, receives lateral displacement force therefrom and is displaced laterally against the sidewall for milling the substantially parallel window. The laterally displaced, substantially parallel reamer may then be used to cut and retrieve a core or cores at zones of interest along the sidewall of the wellbore. The cores are crescent shaped, being scalloped or cut from the sidewall of the existing wellbore, are substantially continuous in length and have a sizable cross section for improved analysis. The length of the core is significant, being limited only by the length of a core retaining passage within the reamer. The core having been taken along the sidewall of the wellbore accurately reflects the lithography of the wellbore at the zones of interest. Further, as coring can now be performed after drilling the wellbore, the cores can be cut at zones of interest in the wellbore, identified previously by well logging and the like.

In a broad aspect of embodiments of the invention apparatus for mounting on the end of a drill string having a rotatable distal end in a wellbore, the apparatus comprises: a reamer, at least a portion of which has a rotatable abrasive reaming tube thereon; a non-rotating lower lateral displacement means connected to a lower end of the reamer and operable to displace the reamer between a non-displaced position and a laterally displaced position; and an upper lateral displacement means adapted for connection to the rotatable distal end of the drill string and connected to an upper end of the reamer for driveably rotating the abrasive reaming tube and for displacing the reamer between a non-displaced position and a laterally displaced position; and a fluid passage through the upper lateral displacement means and the reamer for supplying drilling fluids from the drill string a downhole end of the abrasive reaming tube, and wherein when the lower and upper lateral displacement means are in the non-displaced position the reamer and abrasive reaming tube are aligned with the wellbore; and when the lower and upper lateral displacement means are actuated to the laterally displaced position, the reamer and abrasive reaming tube are positioned substantially parallel to the wellbore for milling a window in a sidewall of the wellbore.

One embodiment of the apparatus is a tubular workstring or tool comprising three sections: an upper section adapted for connection to a rotatable distal end of a drill string, coiled tubing or the like from surface, a middle section comprising the reamer for milling the window and cutting and retaining a core sample therein and a lower section at the bottom of the workstring. The sections are interconnected by the upper and lower lateral displacement means, which, when actuated, laterally displace and maintain the parallel arrangement of the reamer against the side of the wellbore. The reamer is equipped with an outer reaming tube clad with an abrasive or abrasive protrusions, such as PDC cutters or the like. The reaming tube is rotatable relative to a non-rotataing inner section or mandrel which is connected to the non-rotatable upper and lower sections of the apparatus. Rotary motion is transferred to the reaming tube through drive means, located in the upper section. The reaming tube is rotatably supported and retained on the mandrel by bushings or bearings.

The lower lateral displacement means, laterally displaces the reaming tube via a displacement crank or link which provides lateral force to a bottom end of the reaming tube in a particular direction. The lower section of the apparatus contains actuation means to actuate the lateral displacement means. Actuation may be by power generation means, such as by a hydraulic power unit generating hydraulic pressure via an accumulator, an electric motor, spring pressure or force from a motor-driven linear actuator. Preferably, the link is actuated through linear motion from a hydraulic ram powered by a hydraulic unit in the lower section of the apparatus.

The upper section comprises a driveshaft having U-joints so as to enable parallel offset of the reaming tube. The bottom U-joint accommodates transferring of the drill string's torque to the rotatable reaming tube, provides drilling fluid flow to the reaming tube, and exerts push or pull to the reaming tube and lower section of the apparatus in the particular direction.

The upper lateral displacement means comprises a spindle, extending from the drive means to engage the mandrel. Preferably, the spindle engages a biased socket in an axially shiftable housing to permit lateral displacement of the upper end of the reamer in the same direction as the lower end of the reamer. The axis of the socket is shifted similarly with the lower link action so as to direct the top of the biasing section in the direction of the lower link action.

To achieve the parallel orientation of the reamer and to avoid a jack-knife effect, the lower and upper lateral displacement means straddling the reaming tube are connected through the mandrel. Preferably, the mandrel is a mechanical member running inside the apparatus along the entire length of the reamer and forms the fluid bypass conduit in the reaming tube for providing drill fluid to be circulated through the bottom of the reamer for removing cuttings and cleaning the hole.

In a broad embodiment of a method of use, a method for milling a window in a wellbore comprises: providing a tool having a non-rotating lower section and an upper section and a reamer connected therebetween, the tool being positionable in the wellbore and each of the upper and lower sections being actuable between a non-displaced position aligned in the wellbore and a laterally displaced position parallel and offset from the wellbore; and positioning the tool in the wellbore; actuating at least the lower section to displace a lower end of the reamer; rotating an abrasive outer surface of the reamer to form a window in a sidewall of the wellbore; manipulating the tool uphole and downhole, as necessary, to lengthen the window and forming a parallel window substantially parallel to the wellbore; and actuating an upper section to displace an upper end of the reamer into the parallel window so that the reamer is positioned substantially parallel to the wellbore.

In another broad aspect of the method for obtaining a core sample, wherein the reamer has a non-rotating mandrel extending therealong and having a core-receiving passage therein and wherein the rotating abrasive outer surface further comprises a coring head, the method further comprises: rotating the abrasive reaming tube about the mandrel; lowering the tool downhole from the window and into a zone of interest below the window to cut a crescent-shaped core from the sidewall of the wellbore; and receiving and retaining the crescent-shaped core into the mandrel's core-receiving passage.

BRIEF DESCRIPTION OF THE DRAWINGS

FIG. 3*a* is shown in the aligned position; and FIG. 3*b* is shown in the displaced position;

FIG. 4*a* is shown in the aligned position; and FIG. 4*b* is shown in the displaced position positioned substantially parallel to the wellbore;

FIG. 5*a* is shown in the aligned position; and FIG. 5*b* is shown in the displaced position;

FIG. 8*a* is shown in the aligned position; and FIG. 8*b* is shown in the displaced position;

FIG. 9*a* is shown in the aligned position; and FIG. 9*b* is shown in the displaced position;

FIG. 10*a* illustrates lowering the apparatus into the wellbore, the abrasive reaming tube in the aligned position;

FIG. 10*b* illustrates lateral deflection of the abrasive reaming tube against a sidewall of the wellbore adjacent a zone of interest;

FIG. 10*c* illustrates reaming of a parallel window in the wall of the wellbore by continuing to rotate the abrasive reaming tube;

FIG. 10*d* illustrates a core cut from a bottom of the window and retained in a core retaining passage in the apparatus; and FIG. 10*e* illustrates the apparatus having the abrasive reaming tube aligned in the wellbore, the core retained therein, for removal from the wellbore;

FIG. 11*a* illustrates lowering the apparatus into the wellbore, the abrasive reaming tube in the aligned position adjacent a zone of interest;

FIG. 11*b* illustrates lateral deflection of the abrasive reaming tube;

FIG. 11*c* illustrates reaming of a parallel window in a wall of the wellbore by continuing to rotate the abrasive reaming tube while raising and lowering the apparatus; and FIG. 11*d* illustrates positioning the reaming and coring apparatus at a bottom of the parallel window to commence coring;

FIG. 12*a* is shown in the aligned position; and FIG. 12*b* is shown in the displaced position;

FIGS. 14*a* and 14*b* are longitudinal cross sectional views of a lower end of the abrasive reaming tube illustrating core retaining means, more particularly, FIG. 14*a* illustrates a finger biased into the core receiving passage prior to receiving a core; and FIG. 14*b* illustrates the finger biting into or applying force to a core in the core receiving passage for retaining the core therein.

DETAILED DESCRIPTION OF THE PREFERRED EMBODIMENT

Having reference to FIGS. 1-11*d*, a window reaming and coring apparatus 1 is shown for mounting on the end of a drill string having a rotatable distal end 4. One embodiment is shown schematically in FIGS. 11*a*-11*d*, wherein the apparatus 1 cuts along a sidewall of a wellbore in a formation for forming a window therein, at least a portion of the window being substantially parallel to the axis of the wellbore and along the sidewall of the wellbore, into which a portion of the apparatus 1 can be laterally displaced and subsequently used for cutting a core sample adjacent the sidewall of the wellbore.

Figure 1:
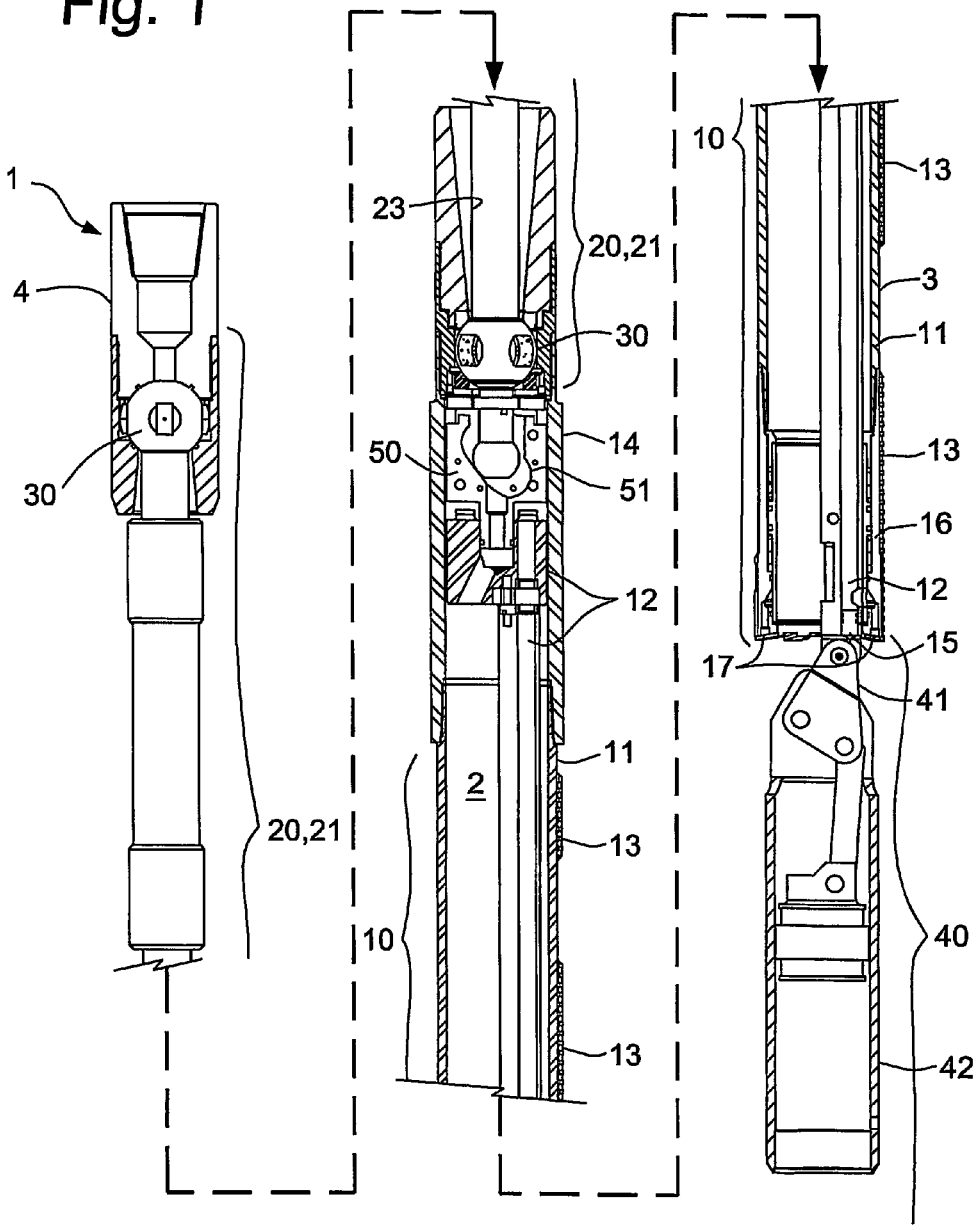
FIG. 1 is a partial longitudinal section view of a window reamer and coring apparatus according to an embodiment of the invention, shown having an abrasive reaming tube in an aligned position for tripping in or out of a wellbore.
Figure 2:
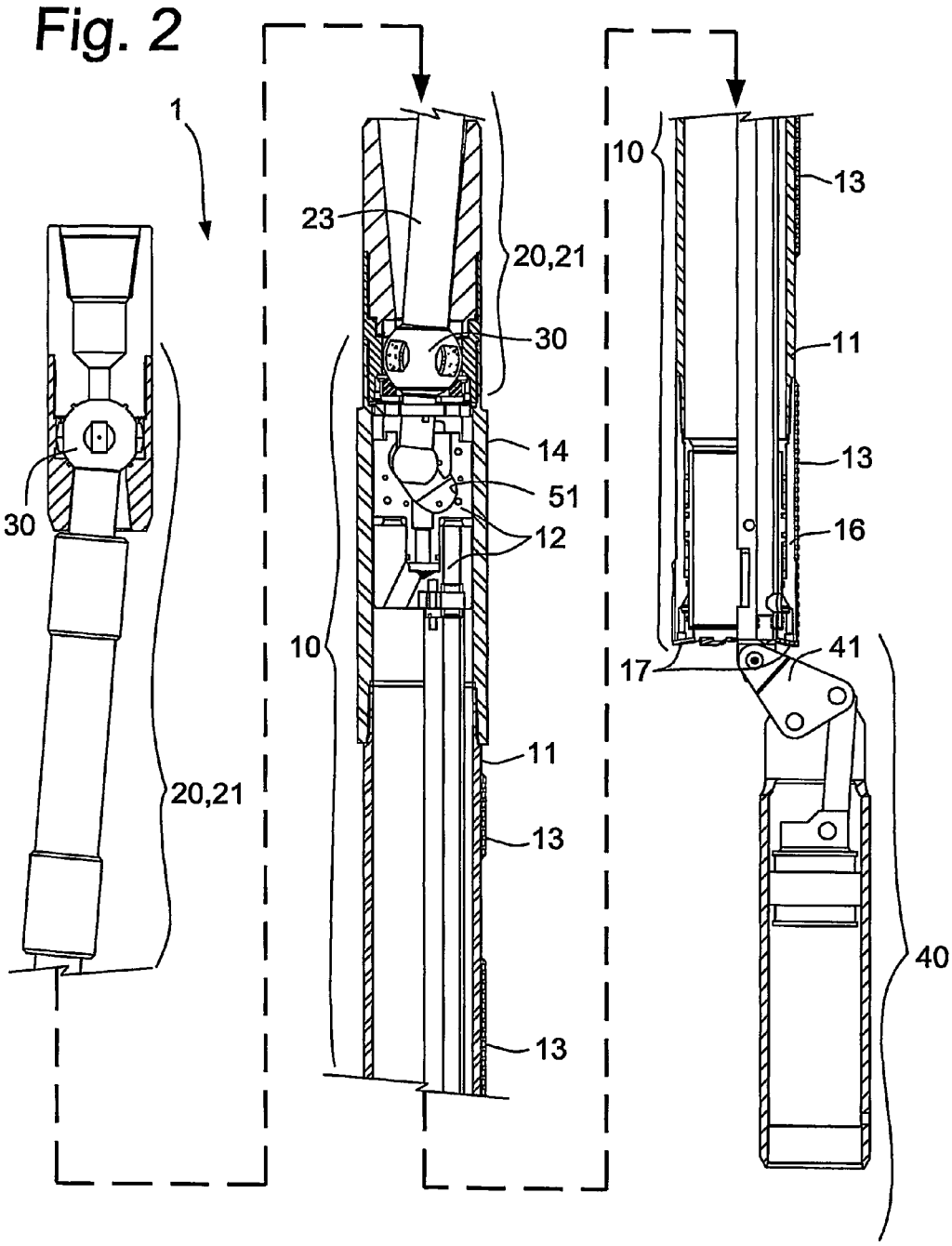
FIG. 2 is a partial longitudinal sectional view according to FIG. 1 and shown having the abrasive reaming tube in a displaced position parallel to an axis of the wellbore.

As shown in FIGS. 1 and 2, the apparatus 1 comprises a reamer 10 comprising a rotatable and abrasive reaming tube 11, the reaming tube 11 having a bore 2 and a non-rotatable mandrel 12, extending along the bore 2. The rotatable reaming tube 11 is clad with cutting elements 13, such as PDC buttons or the like, over at least a portion of an outer surface 3 of the rotatable reaming tube 11.

An upper section 20 of the apparatus 1 comprises upper lateral displacement means 21 which are adapted for connection to the drill string's rotatable distal end 4 through drive means 30 for driveably rotating the abrasive reaming tube 11 and to the non-rotatable mandrel 12 of the reamer 10 for urging at least an upper end 14 of the reamer 10 laterally, between an aligned, non-displaced position and a laterally displaced position.

A lower section 40 of the apparatus 1 comprises non-rotating lower lateral displacement means 41 connected to a lower end 15 of the non-rotatable mandrel 12 and operable to laterally displace at least a bottom end 16 of the reamer 10.

Figure 3A:
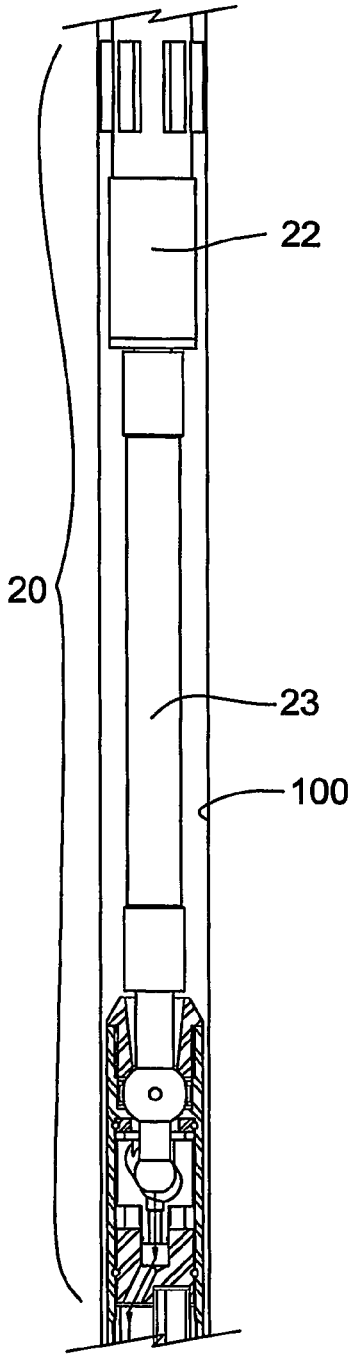
FIGS. 3*a* and 3*b* are partial sectional views of an upper section of the reaming and coring apparatus according to FIG. 1 illustrating an upper lateral displacement means, particularly.
Figure 3B:
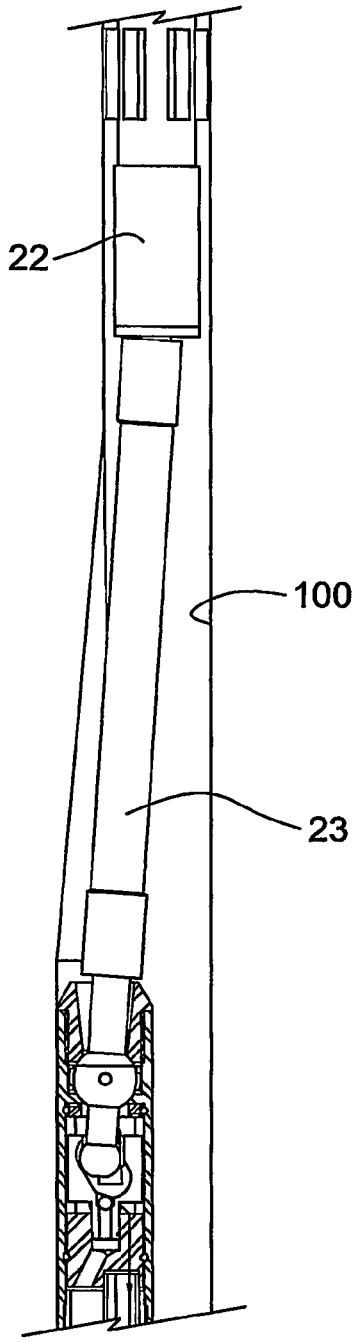
Figure 4A:
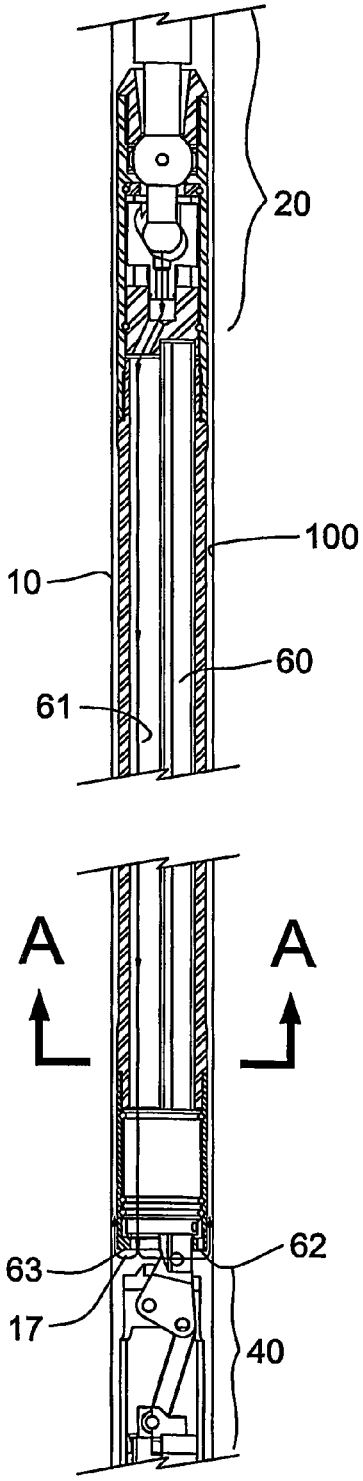
FIGS. 4*a* and 4*b* are partial sectional views of the abrasive reaming tube according to FIG. 1, connected to the upper section and to a lower section by lateral displacement means, more particularly.
Figure 4B:
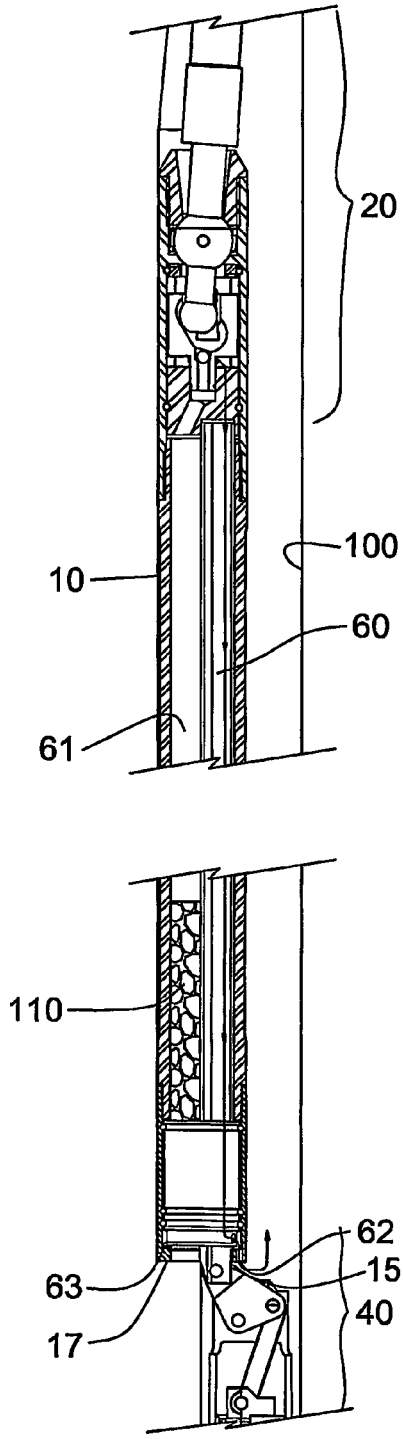
Figure 5A:
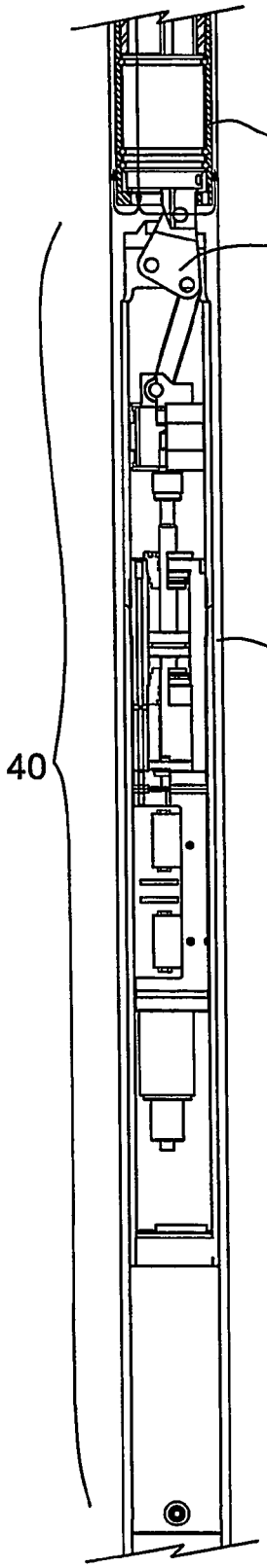
FIGS. 5*a* and 5*b* are partial sectional views of a lower section of the reaming and coring apparatus according to FIG. 1 illustrating a lower lateral displacement means, more particularly.

Before the upper and lower displacement means 21,41 are actuated, and as shown in FIGS. 3*a*, 4*a* and 5*a*, the apparatus 1 is substantially linear and lies within a wellbore 100; After the upper and lower displacement means 21,41 are actuated, the reamer 10 is laterally displaced from the wellbore 100, including up to the extent shown in FIGS. 3*b*, 4*b* and 5*b*.

More particularly, the reamer 10 is actuable between a non-displaced position aligned with the wellbore (FIGS. 1 and 4*a*) and a laterally displaced position offset from the wellbore (FIGS. 2 and 4*b*). In the non-displaced position, the reamer 10 is aligned with the upper and lower sections 20,40 of the apparatus 1, for running the apparatus 1 into an existing wellbore 100. In the laterally displaced position, a least a portion of the reamer 10 is laterally displaced from the upper and lower sections 20,40, and preferably the entire reamer 10 is laterally displaced to a position aligned substantially parallel to a common axis of the upper and lower sections 20,40.

Figures 10A, 10B, 10C, 10D, 10E:
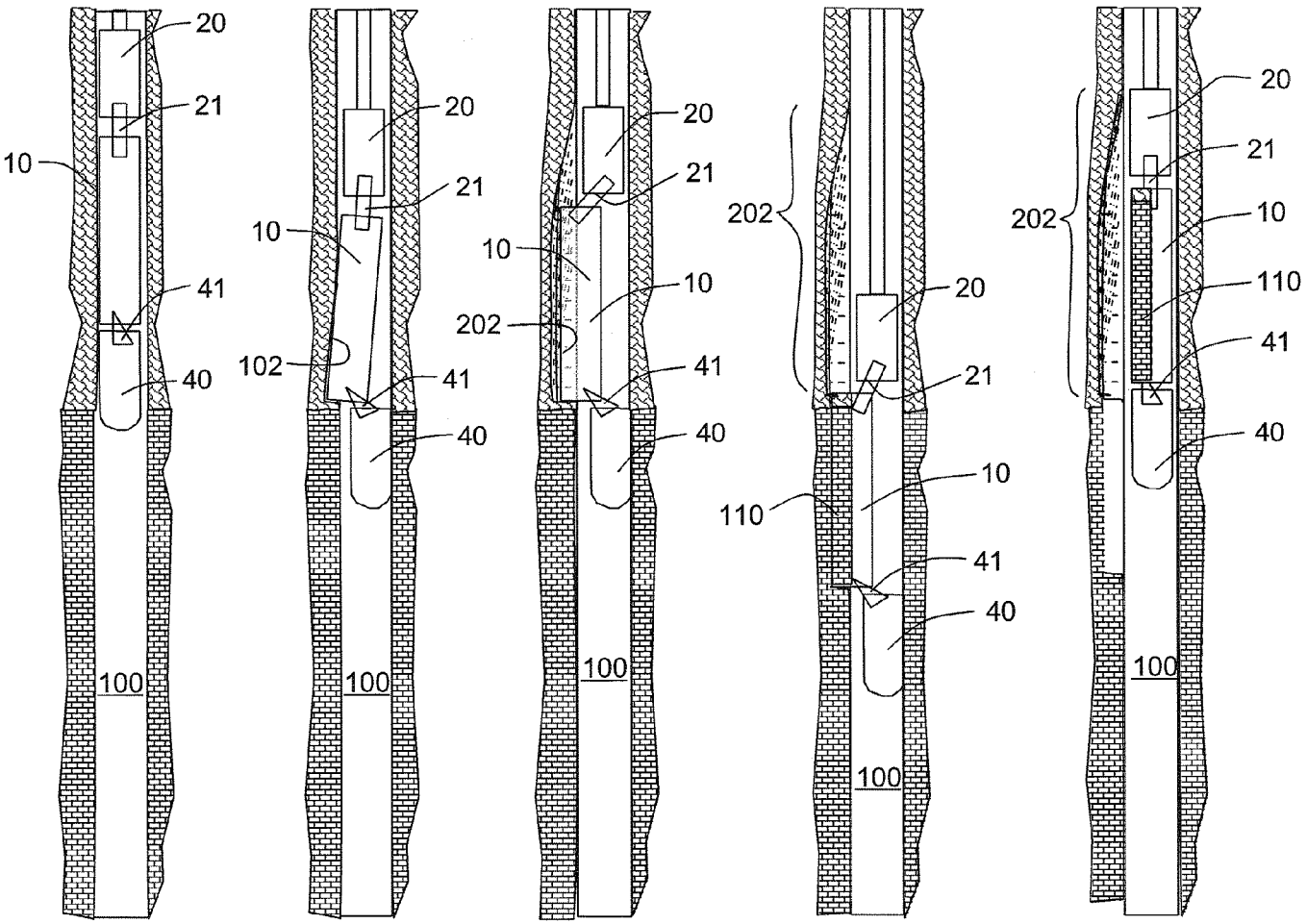
FIGS. 10*a-e* are schematic views of a reaming operation wherein the reaming and coring apparatus is lowered into the wellbore while rotating a portion of the abrasive reaming tube, more particularly.
Figure 11A:
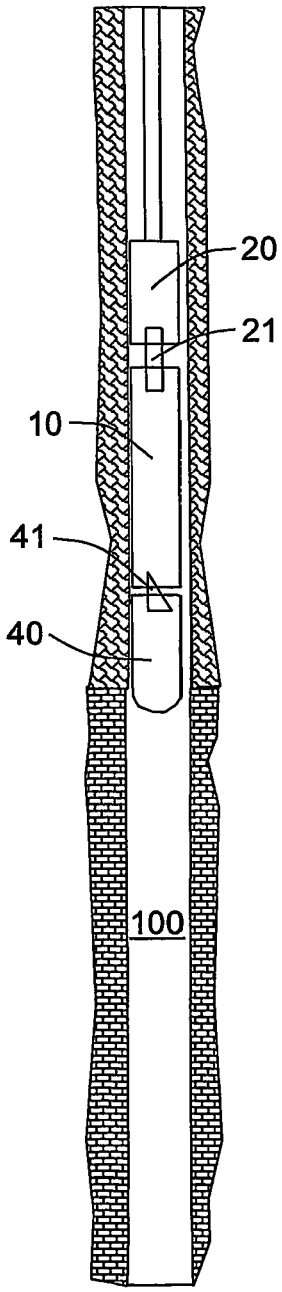
FIGS. 11*a-d* are schematic views of a reaming operation according to FIGS. 10*a-c* and wherein the window is elongated by raising the reaming and coring apparatus while rotating the abrasive reaming tube, more particularly.
Figure 11B:
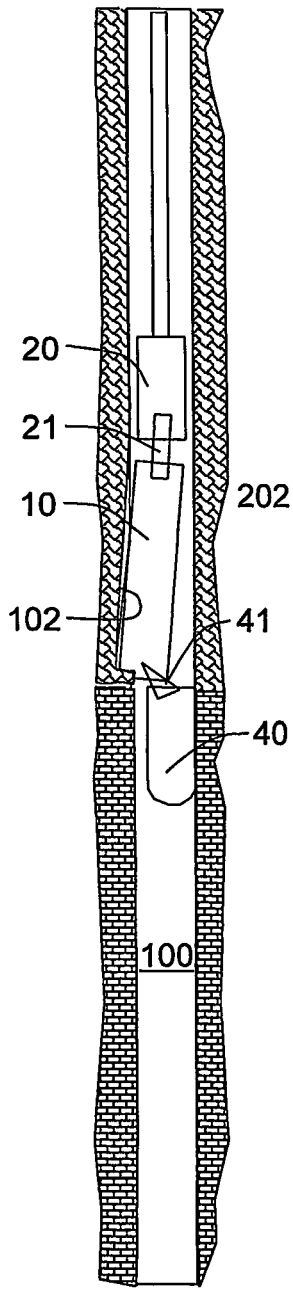

In operation, as shown in FIGS. 10*a-e* and 11*a-d*, the apparatus 1 is lowered into the wellbore 100 to a position adjacent a zone of interest (FIGS. 10*a*, 11*a*), such as immediately above the zone of interest. At least the lower displacement means 41 is actuated to cause the abrasive reaming tube 10 to be displaced laterally against a sidewall 101 of the wellbore 100 (FIGS. 10*b*,11*b*). Displacement force, such as hydraulic or mechanically biased force, results at the upper lateral displacement means 21 and with compressive force applied through the drill string acts to urge the upper displacement means 21 to the laterally displaced position. The upper displacement means 21 orients the reamer 10 to the displaced position. The rotatable reaming tube 11, supported and retained by bushings or bearings on the mandrel 12, is rotated by the drive means 30 to cause the abrasive reaming tube 11 to ream a pocket or window 102 in the sidewall. Fluid, such as drilling mud, is conducted through a main fluid passage 55 extending through the upper lateral displacement means 21 of the apparatus 1 and exits through fluid ports 17 at the bottom end 16 of the reamer 10 to remove cuttings (not shown) generated from the reaming process and clean the wellbore 100. For some operations, a short angular window (FIGS. 10*b* and 11*b*) is sufficient such as to enable re-entry and drilling which is deviated from the original wellbore.

In an operational embodiment to form parallel window 202, as shown in FIGS. 10*a*-10*c*, the apparatus 1 can be positioned, displaced, and rotated to ream and extend the length of the window 102. The window 102 is extended in length to form parallel window 202 which is sufficiently long and deep enough to permit maximum displacement of the upper and lower displacement means 21,41 and the reamer 10.

Figure 11C:
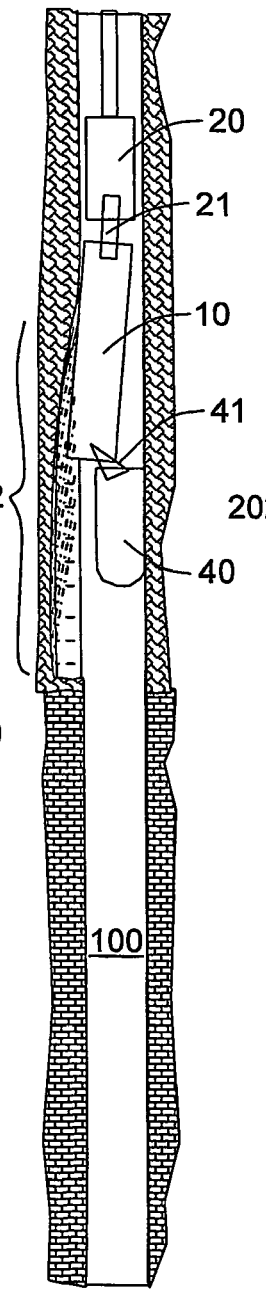

Optionally, to lengthen the Window 102, and as shown in FIG. 11*c*, the apparatus 1 can be positioned, displaced and then lifted and lowered, as necessary during reaming to backream the side wall 101 for extending the length of the window 102. Preferably, the window 102 is lengthened to form a parallel window 202 which is sufficiently long and deep enough to permit maximum displacement of the upper and lower displacement means 21,41. In the parallel window 202, the reamer 10 can be displaced so as to align substantially parallel to the axis of the wellbore 100.

Figure 11D:
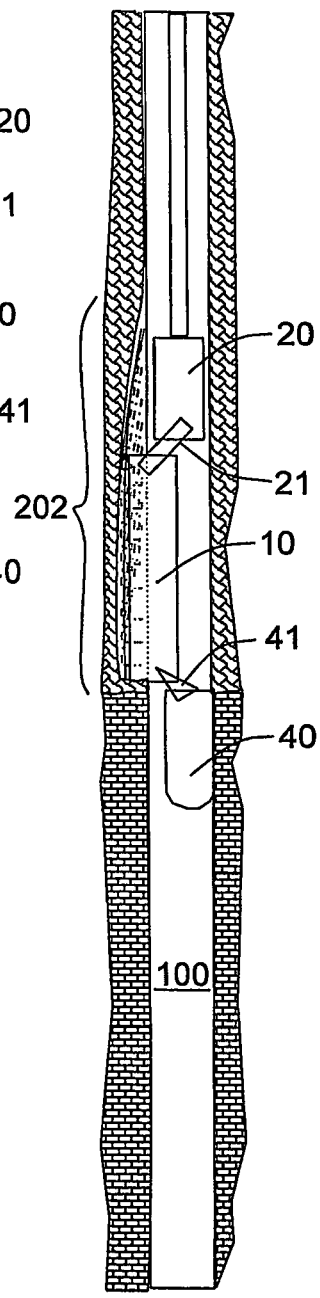

As shown in both FIGS. 10*c* and 11*d*, once the reamer 10 is positioned parallel to the axis of the wellbore 100, a coring operation may begin by advancing the apparatus 1 for cutting and receiving a core therein.

In a preferred embodiment of the invention, as shown in FIGS. 3*a* and 3*b*, the upper section 20 of the apparatus 1 further comprises an uphole portion 22, which remains aligned in a wellbore 100 pivotally connected through the drill string's distal end 4 to a driveshaft 23, which is pivotally and driveably connected to the rotatable abrasive reaming tube 11 of the reamer 10.

The driveshaft 23 comprises an upper U-joint 31 being driveably connected to the uphole portion 22 and a bottom U-joint 32 being driveably connected to the rotatable outer surface 11.

The bottom U-joint 32 enables the reamer 10 to be operable between the aligned position and the displaced position relative to the uphole portion 22. Axial compressive forces and rotation from the uphole portion 22 are transferred to the rotatable abrasive reaming tube 11 through the driveshaft 23 such as those imposed by the drill string (not shown) connected to the uphole portion 22.

Figure 6:
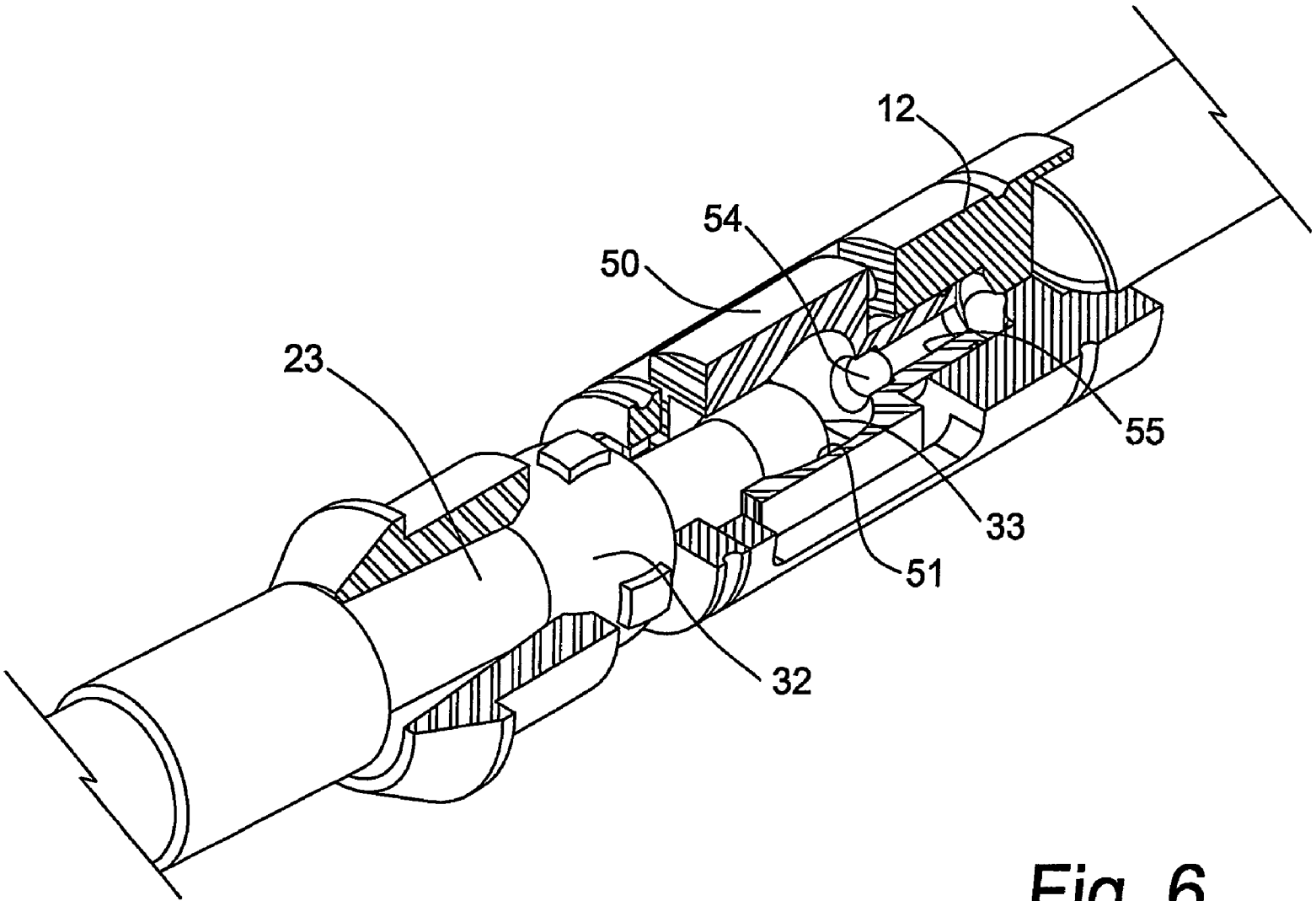
FIG. 6 is a perspective view of a lower U-Joint of a drive assembly according to FIGS. 1-4*b*, illustrating lodging of a ball in a fluid passage for fluid actuation of a piston to shift the piston within a housing to permit lateral displacement of the abrasive reaming tube (the reaming tube omitted for clarity)
Figure 8A:
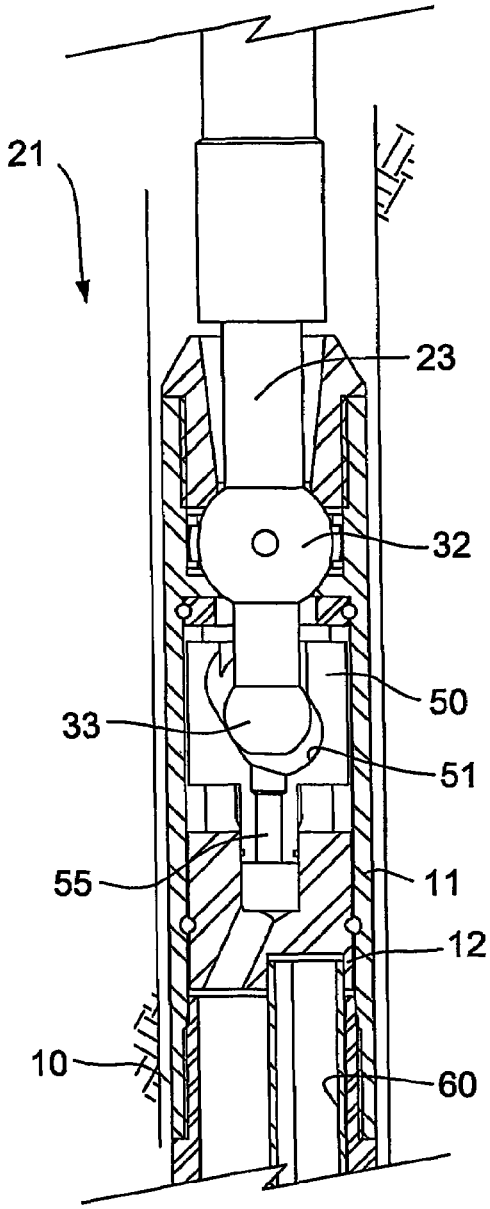
FIGS. 8*a* and 8*b* are cross sectional views of the upper lateral displacement means according to FIGS. 3*a*-*b*, illustrating shifting of the piston within the socket for displacing the abrasive reaming tube laterally, more particularly.
Figure 8B:
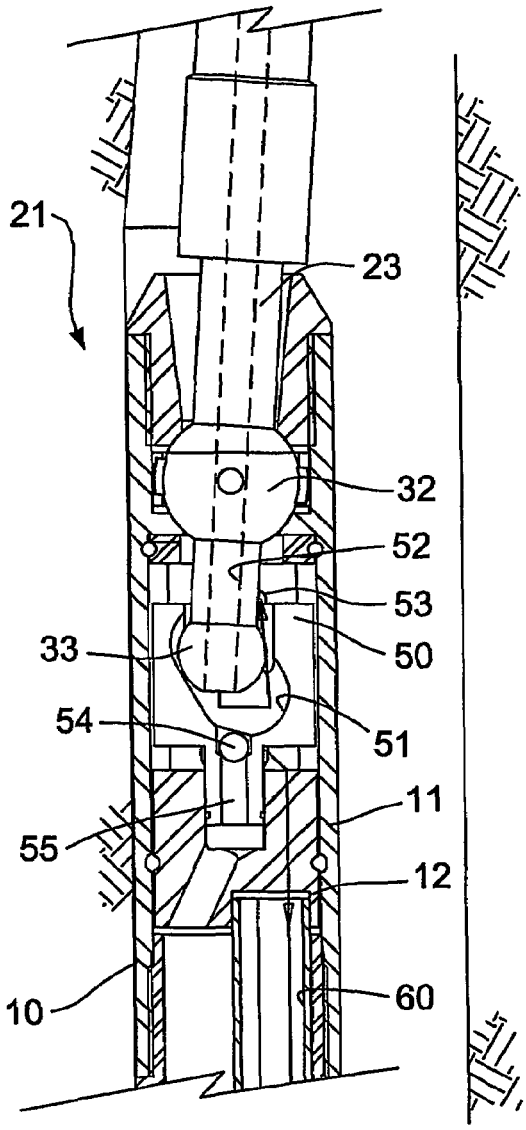
Figure 9A:
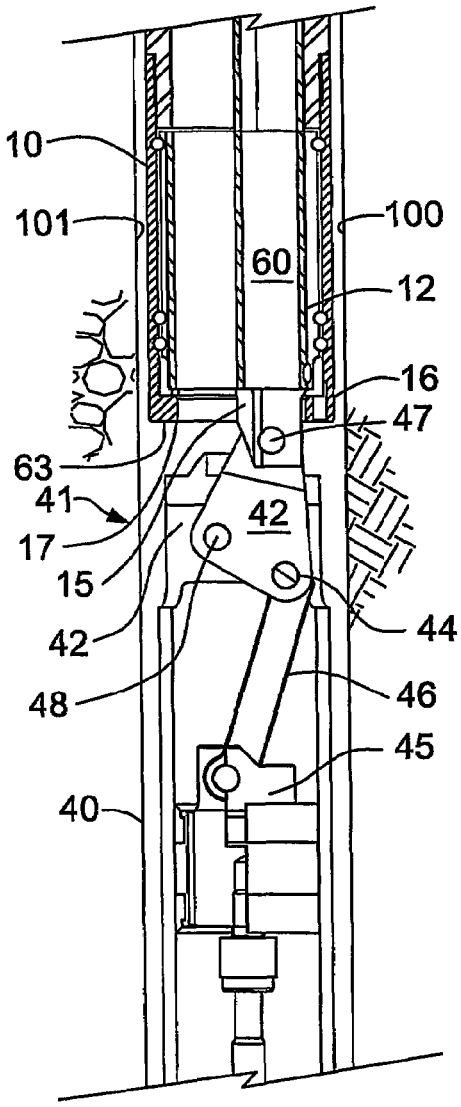
FIGS. 9*a*-*b* are cross sectional views of the lower lateral displacement means according to FIGS. 5*a*-*b*, illustrating a link for lateral displacement of the abrasive reaming tube, more particularly.
Figure 9B:
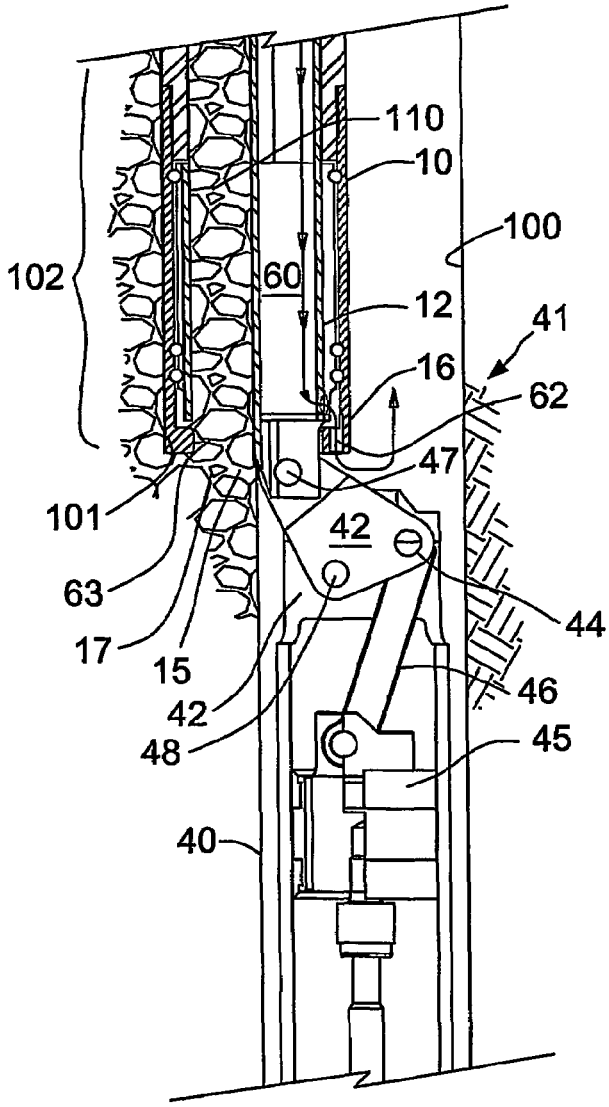

As shown in FIGS. 1, 2, 6 and in greater detail in FIGS. 8*a*-*b*, the upper displacement means 21 comprises a non-rotating housing 50 connected to an upper end of the mandrel 12 adjacent the driveshaft 23 for aligning the driveshaft 23 in the non-aligned position and misaligning the mandrel 12 from the driveshaft 23 in the laterally displaced position.

In a preferred embodiment, the non-rotatable housing 50 is axially moveable within the reaming tube 10 between an uphole position and a downhole position. The abrasive reaming tube 11 is rotatable relative to the housing 50. The housing 50 is operable to vary lateral force onto a spindle 33 extending downwards from the bottom U-joint 32 and thereby laterally displace the upper end 14 of the reamer 10.

The housing 50 further comprises a biased ramp or socket 51 for engaging and displacing the spindle 33, the socket 51 being angled to achieve a desired direction of lateral displacement to enable lateral movement of the spindle 33 thereon as the housing 50 is actuated to shift from the uphole position to the downhole position. The spindle 33 remains freely rotatable in the socket 51 so as to permit rotation of the rotatable abrasive reaming tube 11 by the drive means 30.

In one embodiment, for shifting the housing 50 from the uphole position to the downhole position, a passage 52 is formed through the bottom U-joint 32 and spindle 33. Further, a restricted fluid passage 53 is connected between the housing 50 and a fluid bypass conduit 60 formed in the mandrel 12 of the reamer 10. In operation, and to aid in shifting the housing 50 from the uphole to the downhole position, a plug or small ball 54 is dropped from surface into the fluid flowing through the apparatus 1. The small ball 54 passes through the passage 52 in the U-joint and spindle 32,33 and lodges in the main fluid passage 55 between the housing 50 and the reamer 10, the blockage creating a pressure differential which acts on the housing 50, like a piston, to shift the housing 50 to the downhole position and to divert the flow of fluids to the restricted fluid passage 53 and into the fluid bypass conduit 60.

Figure 5B:
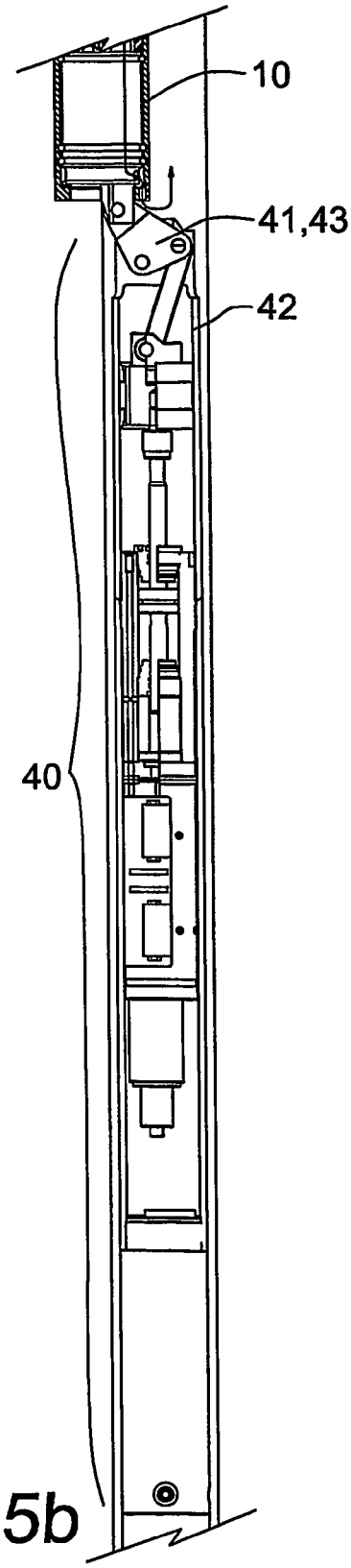

Further, as shown in FIGS. 5*a* and 5*b*, the lower section 40 of the apparatus 1 comprises a downhole portion 42 which remains aligned in the wellbore 100 and an uphole portion 43 which is operable between the aligned position and the displaced position. In the preferred embodiment, as shown in FIGS. 1, 2, 5*a*-5*b* and in greater detail in FIGS. 9*a* and 9*b*, the lower lateral displacement means 41 comprises a link 42 connected to the lower end 16 of the reamer 10 and more particularly to the mandrel 12 of the reamer 10.

Figure 7B:
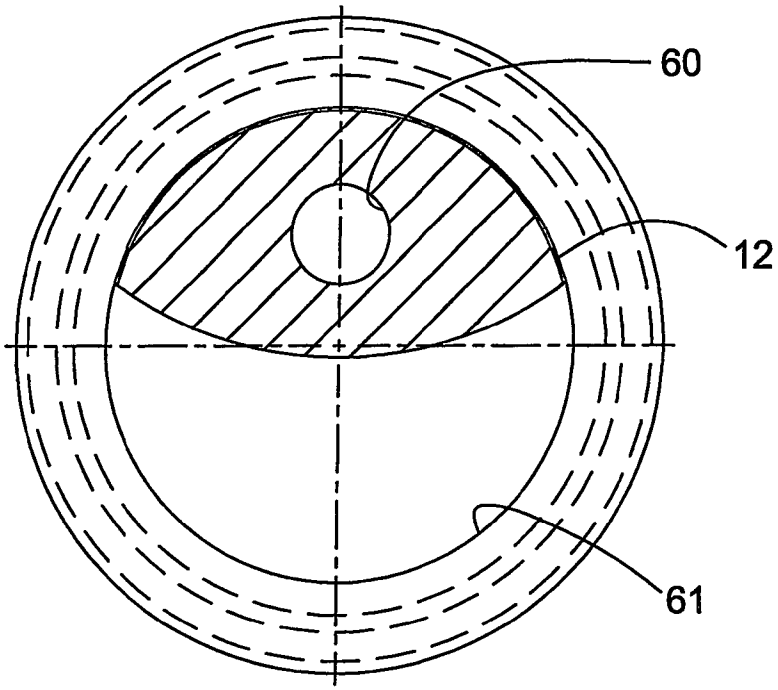
FIG. 7*b* is a cross sectional view of the abrasive reaming tube according to FIG. 4, along section lines A-A, illustrating a core receiving passage and a fluid bypass passage, the fluid bypass passage being a solid structural element having a bore formed therethrough.
Figure 7A:
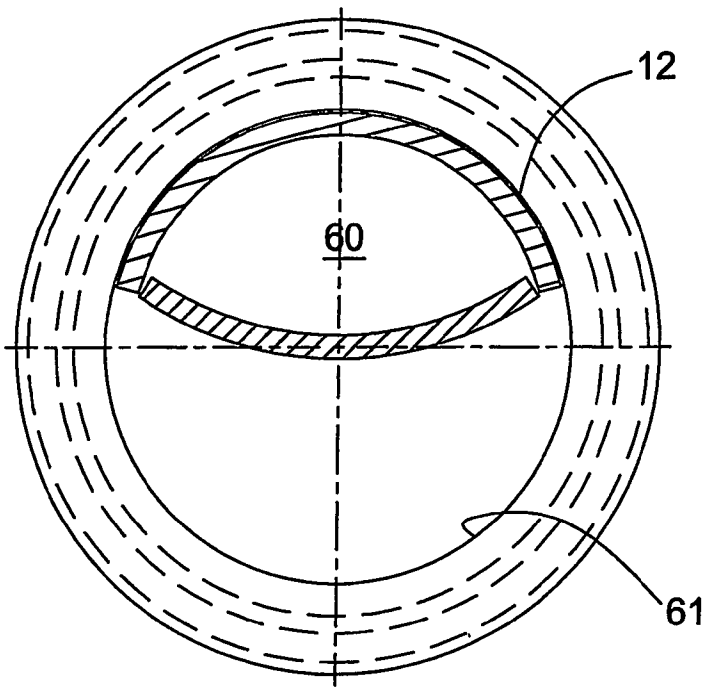
FIG. 7*a* is a cross sectional view of the abrasive reaming tube according to FIG. 4, along section lines A-A, illustrating a core receiving passage and a fluid bypass passage, the fluid bypass passage being a manufactured conduit.

The fluid bypass conduit 60, shown in FIGS. 7*a* and 7*b*, extends from the top end 14 adjacent the housing 50 to the bottom end 16 of the reamer 10 and is non-rotating. The conduit 60 acts as a structural member to connect the non-rotating upper lateral displacement means 21 generally to the non-rotating lower lateral displacement means 41 and to assist in achieving parallel orientation of reamer 10 and to assist in avoiding a "Z" jack-knife effect. The fluid bypass conduit 60 may be a manufactured conduit as shown in FIG. 7*a* or a solid structural member having a bore formed therethrough as shown in FIG. 7*b*. The rotatable reaming tube 11 is supported and retained thereon by bushings and bearings.

The link 43 is connected at a first point 44 to actuation means 45 positioned in the uphole portion 42 of the lower section 40 of the apparatus 1. More particularly, the link is connected to a ram 46 which may be actuated by hydraulics, an electric motor, an accumulator or a linear actuator or the like. Further, the link 43 is connected at a second point 47 to the bottom end 15 of the mandrel 12 of the reamer 10 and pivotally at a third point 48 to the uphole portion 42 of the lower section 40 of the apparatus. The link 43 is manipulated by the ram 46, when actuated, to rotate about the third point 48 to displace the bottom end 16 of the reamer 10, laterally.

In the preferred embodiment, when hydraulic pressure is applied to the ram 46, the linear motion of the ram 46 pivots the link 43 resulting in radial displacement of the bottom 16 of the reamer 10, thus anchoring the apparatus 1 inside of wellbore 100 and exerting perpendicular force against the sidewall 101.

Figure 12A:
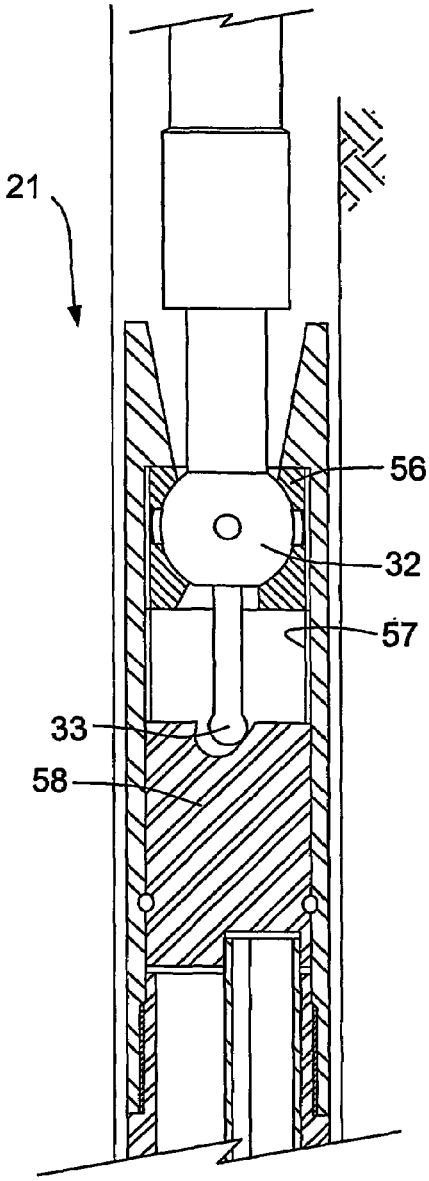
FIGS. 12*a* and 12*b* are longitudinal cross sectional views of an alternate embodiment of the upper displacement means, more particularly.
Figure 12B:
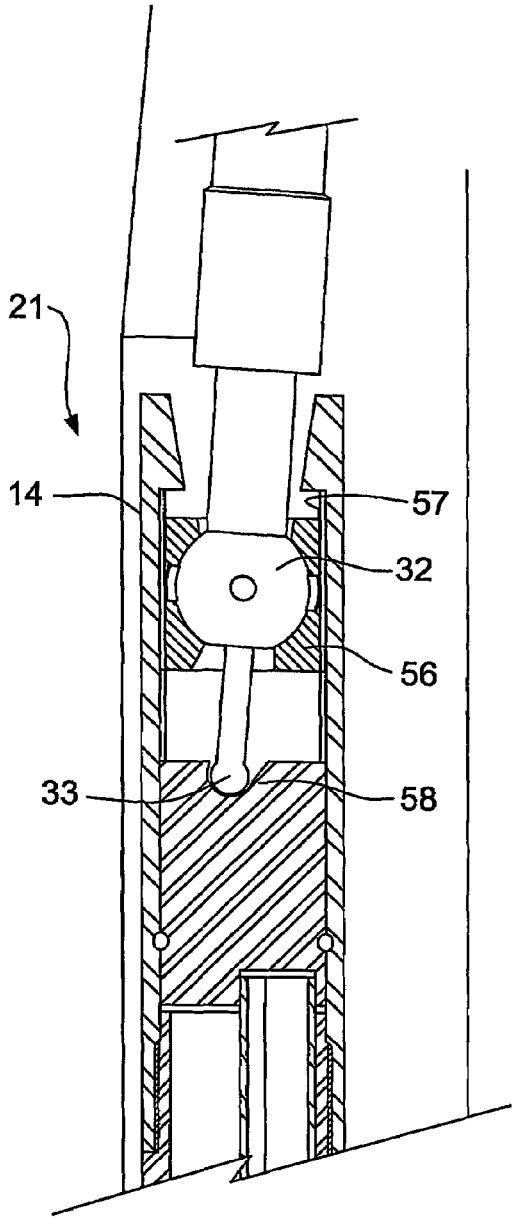
Figure 13:
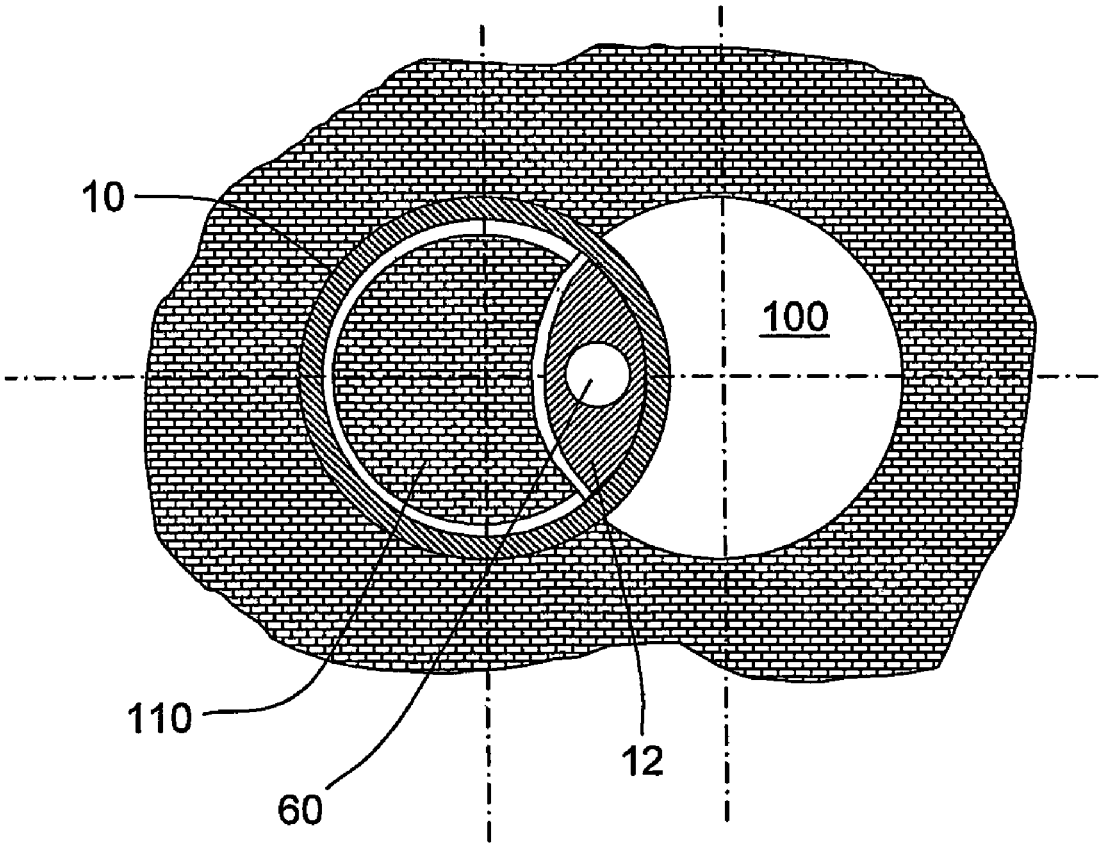
FIG. 13 is a cross-sectional view of the apparatus in the wellbore having had a parallel window reamed therein and a crescent-shaped core retained in the apparatus.

Having reference to FIG. 13, the extent of the maximal displacement of the reamer 10 is limited by the extent of motion of the upper and lower displacement means 21,41 and is preferably sized to obtain the maximum thickness of the core sample while still maintaining the fluid bypass conduit 60 therein. More preferably, the maximum displacement is about or greater than one half the diameter of the reamer 10 resulting in an oblong shaped wellbore 100 at the window 102. Alternately, in an embodiment of the invention as shown in FIGS. 12*a*-*b*, the upper lateral displacement means 21 may comprise a splined housing 56 formed about the bottom U-joint 32 which is axially shiftable from an uphole position to a downhole position on a splined inner surface 57 of an upper portion of the reaming tube 10. A wedge 58 is positioned below the bottom U-joint 32 and the spindle 33 extending therefrom. As load is applied to the drill string (not shown), the splined housing 56 and bottom U-joint and spindle 32,33 are shifted to the downhole position and the spindle 33 is driven down the wedge 58 to displace the upper end 14 of the reamer 10, laterally.

Optionally, the upper and lower lateral displacement means 21,41 can be actuated by applying weight onto the drill string (not shown). In order to actuate in this manner, the lower section 40 of the apparatus 1 must be first temporarily anchored in the wellbore 100 using anchors or packers and the like. Alternately, a tailpipe piece may be added to the lower section 40 of the apparatus 1 for bottoming in the wellbore 100. Once anchored, weight applied to the apparatus 1 will cause the displacement means 21, 41 to be actuated and initiate the process of forming a window 102. In order to continue to core, once the reamer 10 has been displaced, the anchors must be released to permit uphole or downhole reaming or coring movement of the apparatus 1.

Further, in certain circumstances reactive torque may be produced. The drill string (not shown) can be set on the bottom of the wellbore 100 to resist downhole and rotary forces. Otherwise, in order to initiate and maintain the displacement of the reaming tube and hold reactive torque-generated forces induced by rotary motion, the lower section can be equipped with apparatus such as anchors or packers for retaining the bottom section in relation to the wellbore.

As shown in FIGS. 10*d* and 10*e* and in a preferred operation, once the parallel window 202 has been reamed and the reamer 10 is fully displaced laterally relative to the remainder of the apparatus 1 and the wellbore 100, a core sample 110 may be cut and retained therein.

As shown in FIGS. 4*a-b*, 7*a-b*, 9*a-b* and 13, the rotatable abrasive reaming tube 11 of the reamer 10 comprises the mandrel 12, containing the fluid bypass conduit 60 and a core receiving passage 61 formed therein. The core receiving passage 61 is crescent-shaped to correspond with a crescent-shaped core 110 cut from the sidewall 101 of the wellbore 100 as the reamer 10 advances therealong (FIG. 13). Force applied to the apparatus 1 through the drill string and rotation of the rotatable abrasive reaming tube 11 cuts the crescent shaped core 110 which is received into the core receiving passage 61 as a continuous core 110. The length of the core 110 is limited only by the length of the core receiving passage 61 and therefore the core 110 can be of significant length. During the coring process, fluid which has been diverted from the housing 50 into the fluid bypass conduit 60 exits through fluid ports 62 at the bottom end 15 of the reamer 10 into the wellbore 100 for cleaning debris resulting from the coring and for cooling the coring head 63.

Preferably, a diamond core-head 63, is fitted to a bottom face 17 of the reaming tube 11 for cutting the core 110. The coring proceeds at a bottom 103 of the window 102 by pushing the apparatus 1, rotating the abrasive reaming tube 11 and circulating fluid therethrough.

With reference to FIGS. 14*a* and 14*b*, core retaining means 70 are positioned adjacent a bottom end 64 of the core-receiving passage 61 for retaining the core 110 therein. In a preferred embodiment, the core retaining means 70 is a finger 71 biased outwardly by a spring 72 into the core receiving passage 61. The core 110, as it enters the passage 61, forces the finger 70 to rotate uphole against a wall 65 of the core receiving passage 61. Once the core 110 is fully received into the core receiving passage 61, the biased finger 70 bites or otherwise exerts force onto the core 110, retaining the core 110 in the core receiving passage 61.

Alternately, the core retaining means 70 may be a slip or dog (not shown) set in the wall 65 of the core receiving passage 61 and biased outwardly into the core receiving passage 61.

Once the core 110 has been cut, received and retained in the core receiving passage 61, the lower displacement means 41 are actuated to retract the reamer 10, containing the core 110, into alignment with the axis of the wellbore 100. Tension applied to the drill string causes the upper displacement means 21 to realign. Once aligned, the apparatus 1 is lifted to surface where the core 110 can be retrieved therefrom for analysis.

The embodiments of the invention in which an exclusive property or privilege is claimed are defined as follows:

1. Apparatus for mounting on the end of a drill string having a rotatable distal end in a wellbore, the apparatus comprising:

a reamer, at least a portion of which has a rotatable abrasive reaming tube thereon, the abrasive reaming tube having a bore, the bore adaptable for receiving a core;

a non-rotating mandrel extending along the bore of the abrasive reaming tube, the abrasive reaming tube being rotatable about the mandrel;

a non-rotating lower lateral displacement means connected to a lower end of the mandrel and operable to displace the reamer between a non-displaced position and a laterally displaced position; and an upper lateral displacement means adapted for connection to the rotatable distal end of the drill string and connected to an upper end of the reamer for driveably rotating the abrasive reaming tube and for displacing the reamer between a non-displaced position and a laterally displaced position; and a fluid passage through the upper lateral displacement means and the reamer for supplying drilling fluids from the drill string to a downhole end of the abrasive reaming tube, and wherein when the lower and upper lateral displacement means are in the non-displaced position, the reamer and abrasive reaming tube are aligned in the wellbore; and when the lower and upper lateral displacement means are actuated to the laterally displaced position, the reamer and abrasive reaming tube are positioned substantially parallel to the wellbore for milling a window in a sidewall of the wellbore.

2. The apparatus of claim 1 wherein the upper lateral displacement means further comprises:

a driveshaft adapted for pivoting connection to the rotatable distal end of the drill string and pivotally and driveably connected to the rotatable abrasive reaming tube; and a non-rotating housing connected to an upper end of the mandrel adjacent the driveshaft and engagable therewith for aligning the mandrel with the driveshaft in the non-displaced position and misaligning the mandrel from the driveshaft in the displaced position.

3. The apparatus of claim 2 wherein:

the drive shaft further comprises a lower universal joint having a spindle projecting therefrom for relative rotational coupling with the non-rotational housing, and the non-rotating housing further comprises a ramp for engaging the spindle wherein relative axial movement of the spindle and the housing laterally displaces the spindle for alignment or misalignment of the driveshaft and the mandrel.

4. The apparatus of claim 3 wherein the housing is hydraulically actuable between an uphole and a downhole position for moving the ramp and displacing the spindle.

5. The apparatus of claim 3 wherein the bottom universal joint is axially movable between an uphole and a downhole position relative to the ramp for displacing the spindle.

6. The apparatus of claim 5 further comprising a splined connection between the lower universal joint and the abrasive reaming tube for enabling rotatable drivable connection and axial movement therebetween.

7. The apparatus of claim 1 wherein the bore further comprises:

a core-receiving passage for retaining a core therein; and a fluid bypass conduit, wherein when the reamer is in the displaced position and when the drill string moves downhole in the wellbore, the core is received into the core-receiving passage and drilling fluids are supplied to the downhole end of the abrasive reaming tube through the fluid bypass conduit.

8. The apparatus of claim 7 wherein the abrasive reaming tube further comprises a core head positioned at a lower end of the abrasive reaming tube for cutting the core when rotated, the core being received into the core-receiving passage as the reamer is moved downhole.

9. The apparatus of claim 8 wherein:

the core-receiving passage is crescent-shaped and the fluid passage is positioned axially within the mandrel; and lateral displacement of the abrasive reaming tube is limited for cutting a crescent-shaped core, sized to be retained within the crescent-shaped core-receiving passage.

10. The apparatus of claim 7 further comprising a core retainer positioned adjacent a lower end of the core-receiving passage for retaining the core therein.

11. The apparatus of claim 10 wherein the core retainer is a finger biased between a non-engaged position for permitting receipt of the core thereby and into the core-receiving passage and an engaged position for restricting at least a portion of the core-receiving passage for retaining the core therein.

12. The apparatus of claim 1 wherein the lower lateral displacement means further comprises:

a lower section positioned in the wellbore; and a link having a first point of connection to an actuator in the lower section, a second point of connection in the lower section about which the link pivots, and a third point of connection to the lower end of the mandrel, wherein when the actuator actuates the first point of connection, the link pivots about the second point of connection for laterally displacing the mandrel and the abrasive reaming tube.

13. The apparatus of claim 12 wherein the actuator is selected from the group comprising hydraulics, accumulator, electric motor, spring pressure and motor-driven linear actuator.

14. The apparatus of claim 12 wherein the link is actuated through relative movement of the drill string and the lower section.

15. The apparatus of claim 14 further comprising an anchor for temporarily anchoring the lower section in the wellbore.

16. A method for milling a window in a wellbore comprising:

providing a tool having a non-rotating lower section and an upper section and a reamer connected therebetween, the reamer having a bore adaptable for receiving a core and a non-rotating mandrel extending along the bore of the reamer, the reamer being rotatable about the mandrel, the tool being positionable in the wellbore and each of the upper and lower sections being actuable between a non-displaced position aligned in the wellbore and a laterally displaced position parallel and offset from the wellbore; and positioning the tool in the wellbore;

actuating at least the lower section to displace a lower end of the reamer;

rotating an abrasive outer surface of the reamer to form a window in a sidewall of the wellbore;

manipulating the tool as necessary to lengthen the window for forming a parallel window substantially parallel to the wellbore; and actuating the upper section to displace an upper end of the reamer into the parallel window so that the reamer is positioned substantially parallel to the wellbore.

17. The method of claim 16 wherein the reamer has a non-rotating mandrel extending therealong and wherein the rotating abrasive outer surface further comprises a core-receiving passage and a coring head, the method further comprising:

rotating the abrasive outer surface about the mandrel;

lowering the tool downhole from the window for lowering the coring head into a zone of interest below the window to cut the core from the sidewall of the wellbore, wherein said core is crescent-shaped from the sidewall of the wellbore; and receiving the crescent-shaped core into the core-receiving passage.

18. The method of claim 16 wherein the tool manipulating step further comprises lowering the tool for elongating the substantially parallel window.

19. The method of claim 16 wherein the tool manipulating step further comprises lifting and lowering the tool uphole and downhole for backreaming and elongating the substantially parallel window.

20. The method of claim 16 wherein the lower section is connected to a lower end of a non-rotating mandrel and wherein actuating of at least the lower section of the reamer further comprises:

laterally displacing the lower end of the reamer relative to the lower section; and orienting the upper end of the reamer upon laterally displacing the upper end of the reamer relative to the upper section for displacing the reamer into the parallel window.

* * * * *